US006540849B2

(12) United States Patent
DiCarlo et al.

(10) Patent No.: US 6,540,849 B2
(45) Date of Patent: Apr. 1, 2003

(54) PROCESS FOR THE IMPROVED DUCTILITY OF NITINOL

(75) Inventors: Paul DiCarlo, Middleboro, MA (US); Steven E. Walak, Natick, MA (US)

(73) Assignee: SciMed Life Systems, Inc., Maple Grove, MN (US)

( * ) Notice: Subject to any disclaimer, the term of this patent is extended or adjusted under 35 U.S.C. 154(b) by 0 days.

(21) Appl. No.: 09/507,753

(22) Filed: Feb. 22, 2000

(65) Prior Publication Data

US 2002/0185200 A1 Dec. 12, 2002

Related U.S. Application Data

(60) Division of application No. 09/088,684, filed on Jun. 2, 1998, now Pat. No. 6,106,642, which is a continuation-in-part of application No. 09/026,170, filed on Feb. 19, 1998, now abandoned.

(51) Int. Cl.[7] ..... C22C 19/03; C22K 1/00
(52) U.S. Cl. ..... 148/402; 148/563
(58) Field of Search ..... 148/563, 402, 148/675

(56) References Cited

U.S. PATENT DOCUMENTS

| | | | | |
|---|---|---|---|---|
| 3,948,688 | A | 4/1976 | Clark | 148/11.5 R |
| 3,953,253 | A | 4/1976 | Clark | 148/131 |
| 3,957,206 | A | 5/1976 | Mason | 239/265.33 |
| 4,144,057 | A | 3/1979 | Melton et al. | 75/134 C |
| 4,283,233 | A | 8/1981 | Goldstein et al. | 148/11.5 R |
| 4,304,613 | A | 12/1981 | Wang et al. | 148/11.5 N |
| 4,389,250 | A | 6/1983 | Melton et al. | 75/232 |
| 4,404,025 | A | 9/1983 | Mercier et al. | 148/11.5 F |
| 4,484,455 | A | 11/1984 | Hochstein | 148/563 |
| 4,484,955 | A | 11/1984 | Hochstein | |
| 4,586,969 | A | 5/1986 | Tamura et al. | 148/402 |
| 4,654,092 | A | 3/1987 | Melton | 148/402 |

(List continued on next page.)

FOREIGN PATENT DOCUMENTS

| | | |
|---|---|---|
| EP | 0167221 | 1/1986 |
| EP | 0297004 | 12/1988 |
| JP | 0113167 | 6/1984 |

(List continued on next page.)

OTHER PUBLICATIONS

National Aeronautics and Space Administration; "Mechanical Properties"; 55–Nitinol–The Alloy With a Memory: Its Physical Metallurgy, Properties, and Applications; Chapter 5, pp. 57–63.

*Primary Examiner*—George Wyszomierski
(74) *Attorney, Agent, or Firm*—Kenyon & Kenyon

(57) ABSTRACT

A process for treating nitinol so that desired mechanical properties are achieved. In one embodiment, the process comprises the steps of exposing the nitinol to a primary annealing temperature within the range of approximately 475° C. to 525° C. for a first time period, and thereafter exposing the nitinol to a secondary annealing temperature within the range of approximately 550° C. to 800° C. for a second time period. The invention also includes nitinol articles made by the process of the invention.

14 Claims, 4 Drawing Sheets

U.S. PATENT DOCUMENTS

| | | | | | |
|---|---|---|---|---|---|
| 4,707,196 | A | | 11/1987 | Honma et al. | 148/12.7 N |
| 4,878,954 | A | | 11/1989 | Dubertret et al. | 148/11.5 F |
| 4,935,068 | A | | 6/1990 | Duerig | 148/11.5 C |
| 5,026,441 | A | | 6/1991 | Kim et al. | 148/402 |
| 5,114,504 | A | | 5/1992 | AbuJudom, II et al. | 148/402 |
| 5,171,383 | A | | 12/1992 | Sagaye et al. | 148/564 |
| 5,531,369 | A | | 7/1996 | Richman et al. | 228/109 |
| 5,562,641 | A | | 10/1996 | Flomenblit et al. | 604/281 |
| 5,578,149 | A | | 11/1996 | De Scheerder et al. | 148/563 |
| 5,624,508 | A | | 4/1997 | Flomenblit et al. | 148/510 |
| 5,637,089 | A | | 6/1997 | Abrams et al. | 604/95 |
| 5,641,364 | A | | 6/1997 | Goldberg et al. | 148/563 |
| 5,667,522 | A | | 9/1997 | Flomenblit et al. | 606/198 |
| 5,876,434 | A | | 3/1999 | Flomenblit et al. | 623/1 |
| 5,882,444 | A | | 3/1999 | Flomenblit et al. | 148/510 |
| 5,958,159 | A | * | 9/1999 | Prandi | 148/402 |
| 6,106,642 | A | * | 8/2000 | DiCarlo et al. | 148/563 |

FOREIGN PATENT DOCUMENTS

| | | | |
|---|---|---|---|
| JP | 0150047 | | 8/1984 |
| JP | 0150069 | | 8/1984 |
| JP | 0170247 | | 9/1984 |
| JP | 0017062 | | 1/1985 |
| JP | 0075562 | | 4/1985 |
| JP | 0103165 | | 6/1985 |
| JP | 0141852 | | 7/1985 |
| JP | 0169551 | | 9/1985 |
| JP | 1153249 | A | 7/1986 |
| JP | 0037353 | | 2/1987 |
| JP | 0188764 | | 8/1987 |
| JP | 0199757 | | 9/1987 |
| JP | 6 228404 7 | | 12/1987 |
| JP | 0242763 | | 9/1989 |
| JP | 404136143 | A | 5/1992 |
| JP | 04-329854 | | 11/1992 |
| JP | 06-128709 | | 5/1994 |
| JP | 07-188881 | | 7/1995 |
| JP | 7-196824 | * | 8/1995 |
| WO | WO 94/15544 | | 7/1994 |
| WO | WO 99/16385 | | 4/1999 |

OTHER PUBLICATIONS

ASM Handbook, vol. 4, "Heat Treating", p. 490, ASM, 1991.

Rozner and Wasilewski: Tensile Properties of NiA1 and NiTi J. Inst. Metals. vol. 94, 1966, pp. 169–175.

Jackson, Wagner and Wasilewski: 55–Nitinol–The Alloy with a Memory: Its Physical Metallurgy, Properties and Applications, NASA Report SP–5110, 1972, pp. 57–62 and 83–86.

Rozner and Bueler: Effect of Cold Work on Room–Temperature Tensile Properties of TiNi Intermetallic Compound Transactions of ASM, vol. 59, 1966, pp. 350–352.

Rozner and Bueler Low Temperature Deformation of the TiNi Intermetallic Compound, NOLTR Report 66–38, 1966, pp. 1–6.

Saburi: Ti–Ni Shape Memory Alloys, in Shape Memory Materials, Otsuka and Wayman, eds., 1998, pp. 58–62.

* cited by examiner

PROCESS FOR THE IMPROVED DUCTILITY OF NITINOL

RELATED APPLICATIONS

This application is a division of application Ser. No. 09/088,684, filed Jun. 2, 1998, now U.S. Pat. No. 6,106,642, which is a continuation-in-part of U.S. Ser. No. 09/026,170, filed Feb. 19, 1998, abandoned.

FIELD OF THE INVENTION

The present invention relates to nitinol, and more particularly, to the production of nitinol with enhanced mechanical properties such as ductility.

BACKGROUND

Nitinol, a class of nickel-titanium alloys, is well known for its shape memory and pseudoelastic properties. As a shape memory material, nitinol is able to undergo a reversible thermoelastic transformation between certain metallurgical phases. Generally, the thermoelastic shape memory effect allows the alloy to be shaped into a first configuration while in the relative high-temperature austenite phase, cooled below a transition temperature or temperature range at which the austenite transforms to the relative low-temperature martensite phase, deformed while in a martensitic state into a second configuration, and heated back to austenite such that the alloy transforms from the second configuration to the first configuration. The thermoelastic effect is often expressed in terms of the following "transition temperatures": $M_s$, the temperature at which austenite begins to transform to martensite upon cooling; $M_F$, the temperature at which the transformation from austenite to martensite is complete; $A_s$, the temperature at which martensite begins to transform to austenite upon heating; and $A_f$, the temperature at which the transformation from martensite to austenite is complete.

As a pseudoelastic material, nitinol is able to undergo an isothermal, reversible transformation from austenite to martensite upon the application of stress. This stress-induced transformation to martensite typically occurs at a constant temperature between $A_s$ and $M_d$, the maximum temperature at which martensite can exist in an alloy even under stress conditions. The elasticity associated with the transformation to martensite and the resulting stress-induced martensite make pseudoelastic nitinol suitable for applications requiring recoverable, isothermal deformation. For example, conventional pseudoelastic nitinol is useful for applications requiring recoverable strains of up to 8% or more. See, e.g., U.S. Pat. No. 4,935,068 to Duerig, incorporated herein by reference.

Since being discovered by William J. Buehler in 1958, the unique properties of nitinol have been applied to numerous applications. For example, as reported in C. M. Wayman, "Some Applications of Shape-Memory Alloys," *J. Metals* 129 (June 1980), incorporated herein by reference, nitinol has been used for applications such as fasteners, couplings, heat engines, and various dental and medical devices. Owing to the unique mechanical properties of nitinol and its biocompatibility, the number of uses for this material in the medical field has increased dramatically in recent years.

Although conventional nitinol is known to be an elastic material, its ductility has a limit. For example, U.S. Pat. No. 4,878,954 to Dubertret et al., which is incorporated herein by reference, describes a process for improving the ductility of nitinol whereby up to 49elongation to fracture is achieved. For some applications, however, it is desirable to employ materials having extraordinary ductilities. In addition, it is often desirable to make nitinol components in which the ductility preferentially varies with location such that ductility is highest where needed for proper application.

SUMMARY OF THE INVENTION

In one aspect, the present invention relates to a process for treating nitinol so that desired mechanical properties are achieved. In one embodiment, the process comprises the steps of exposing the nitinol to a primary annealing temperature within the range of approximately 475° C. to 525° C. for a first time period, and thereafter exposing the nitinol to a secondary annealing temperature within the range of approximately 550° C. to 800° C. for a second time period. In one embodiment, the first time period is approximately 10 minutes and the second time period is within the range of approximately 1 to 10 minutes.

In another aspect, the present invention relates to an article comprising nitinol which has been treated according to the above-described process.

In yet another aspect, the present invention relates to nitinol articles having an elongation prior to failure in excess of 500as a result of the above-described process.

DETAILED DESCRIPTION

The present invention provides a process for treating nitinol so that desired mechanical properties are achieved. Most notably, nitinol ductility, expressed as the percent elongation to fracture, is dramatically enhanced by the process of the present invention. The present invention also provides nitinol articles of enhanced mechanical properties as a result of the process of the invention.

Figure 1:
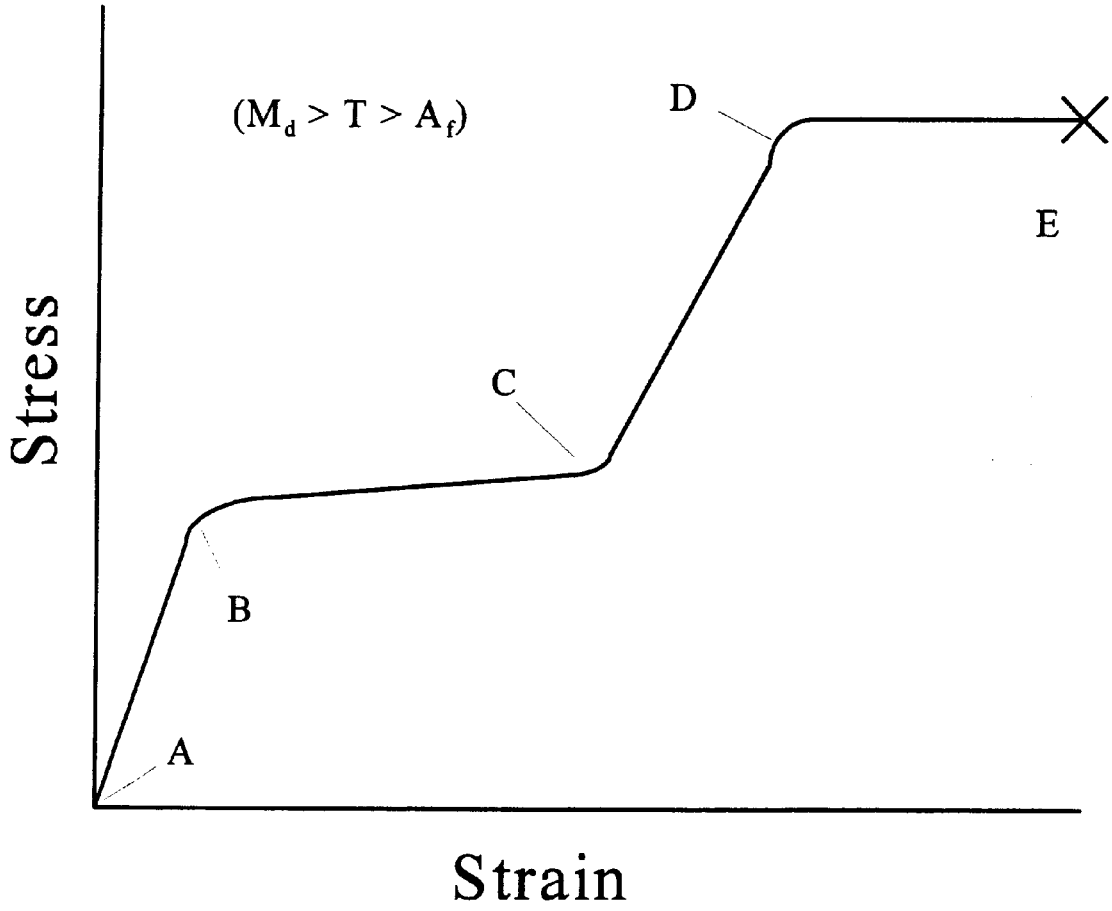
FIG. 1 shows a stress-strain curve for austenitic nitinol that undergoes a stress-induced transformation to martensite.

FIG. 1, which shows a tensile stress-strain curve for a pseudoelastic nitinol alloy initially in an austenitic state and at a temperature above $A_f$ but below $M_d$, provides a basis for describing the present invention. At zero stress (point A), the alloy is in an austenitic state, assuming equilibrium conditions. As stress is applied, the austenite deforms elastically until point B, at which point sufficient stress is applied such that the austenite begins to transform to stress-induced martensite. Between points B and C, the transformation to martensite continues and the existing martensite is re-oriented to reflect the stress conditions. The transformation from austenite to stress-induced martensite is complete at or before point C. Between points C and D, the stress-induced martensite undergoes elastic deformation. If the nitinol alloy is released from its stress state when between points C and D, it should spring back (with some hysteresis effect) to point A to yield the so-called "pseudoelasticity" effect. If the alloy is further stressed, however, the martensite deforms by irreversible plastic deformation between points D and E until fracture occurs at point E.

The ductility of a material is often expressed as the percent elongation to fracture, which is calculated according to the following equation:

$$\% \ el = \frac{l_f - l_0}{l_0} \times 100,$$

where $l_f$ is the length of a tensile sample of the material at fracture and $l_0$ is the original sample length. As previously discussed, treatment processes of conventional nitinol alloys have achieved significant ductilities.

By way of the present invention, the mechanical properties of nitinol are enhanced. For example, the ductility of nitinol is increased to greater than 50% elongation to fracture. In some instances, the ductility is increased to greater than 60%, 70%, 80%, 90% or even 100% elongation to fracture. The process of the present invention comprises the steps of exposing the nitinol to a primary annealing temperature within the range of approximately 475° C. to 525° C. for a first time period, and thereafter exposing the nitinol to a secondary annealing temperature within the range of approximately 550° C. to 800° C. for a second time period. The primary annealing temperature is preferably approximately 500° C., and the secondary annealing temperature is preferably within the range of approximately 600° C. to 800° C. and more preferably within the range of approximately 650° C. to 750° C. In a preferred embodiment, the primary annealing temperature is approximately 500° C. and the secondary annealing temperature is approximately 700° C.

The first and second time periods will obviously depend on the size of the nitinol article being treated. The first and second time periods should be sufficient to ensure that substantially the entire nitinol article reaches the annealing temperatures and is held at the annealing temperatures for a duration of time to have an effect on mechanical properties. For example, for small diameter wire articles (diameter of about 0.01 inches), the preferred first time period is approximately 10 minutes and the preferred second time period is within the range of approximately 1 to 10 minutes.

In accordance with the present invention, a nitinol article is exposed to primary and secondary annealing temperatures by any suitable technique such as, for example, placing the article in a heated fluidized bed, oven or convection furnace. If only a portion of the nitinol article is to undergo the process of the present invention, the portion to be treated is heated by, for example, an inert gas brazing torch (e.g., an argon brazing torch), a laser, or by placing the portion of the article to be treated in contact with a heated object. Such localized annealing results in a nitinol article having properties that vary with location.

The process of the present invention most notably affects the portion of the nitinol stress-strain curve beyond point C as shown in FIG. 1. More specifically, the process of the present invention lengthens region CDE such that overall ductility of nitinol is drastically increased. The advantages of the present invention are thus best exploited by, but not limited to, applications which do not require that the treated nitinol undergo isothermal, reversible pseudoelastic properties. Rather, applications in which an article or portions of the article are preferably highly deformed into the plastic region (region DE on the stress-strain curve shown in FIG. 1) to allow for, for example, positioning, placement, manipulating, etc. the article are best suited to the present invention. It is within the scope of the present invention, however, to make use of the process or articles of the present invention for any applications calling for nitinol of enhanced mechanical properties. For instance, the present invention is useful for application to balloon expandable nitinol stents, for which it often necessary to exceed the elastic range of the nitinol in order to permanently, plastically deform the nitinol during balloon expansion. The present invention is also useful for application to self-expanding stents, wherein the process of the present invention is applied to those portions of the stent structure that do not substantially self-expand. As known in the art, stents are tubular structures used to support and keep open body lumens, such as blood vessels, in open, expanded shapes.

The nitinol alloys used in the present invention include those alloys in which a transformation from austenite to stress-induced martensite is possible. The alloys which typically exhibit this transformation comprise about 40–60 wt % nickel, preferably about 44–56 wt % nickel, and most preferably about 55–56 wt % nickel. These alloys optionally include alloying elements such as, for example, those set forth in U.S. Pat. No. 4,505,767 to Quin (incorporated herein by reference), or may comprise substantially only nickel and titanium. The transition temperatures of the alloys of the present invention, as determined by nitinol composition and thermomechanical processing history, should be selected according to application. For example, where the alloy is intended for use as an austenitic medical device (e.g., arterial stent, blood filter, etc.), the $A_f$ temperature of the alloy should obviously be less than body temperature (about 38° C.).

The present invention is further described with reference to the following non-limiting examples.

EXAMPLE 1

Nitinol wires, each having a length of about 3 inches and a diameter of about 0.009 inch, were obtained. The nitinol comprised approximately 55.9 wt % nickel and the balance titanium. The wire was subjected to a primary anneal by being submerged in a heated fluidized bed of sand at 500° C. for about 10 minutes. Immediately after the primary anneal, the wire was water quenched and then subjected to a secondary anneal by being placed in a fluidized bed of sand at various predetermined temperatures and times. The secondary anneal was also followed by a water quench. The wires were subjected to tensile tests, during which the strain rate was 0.2 inch per minute and the temperature was maintained at about 37° C. The results of the tensile tests are shown in Table I, which illustrates the effect of secondary annealing time and temperature upon nitinol ductility. These results are shown graphically in FIGS. 2 and 3.

| Secondary Annealing Temperature (° C.) | Secondary Annealing Time (min) | % el |
|---|---|---|
| 550 | 1 | 15.5 |
| 550 | 4 | 15.7 |
| 550 | 7 | 15.0 |
| 550 | 10 | 15.3 |
| 600 | 1 | 39.1 |
| 617 | 10 | 78.5 |
| 650 | 1 | 77.2 |
| 650 | 5.5 | 84.3 |
| 650 | 10 | 87.9 |

-continued

| Secondary Annealing Temperature (° C.) | Secondary Annealing Time (min) | % el |
|---|---|---|
| 675 | 10 | 89.2 |
| 700 | 10 | 92.7 |
| 750 | 10 | 88.6 |
| 775 | 10 | 86.4 |
| 800 | 10 | 73.5 |

Figure 2:
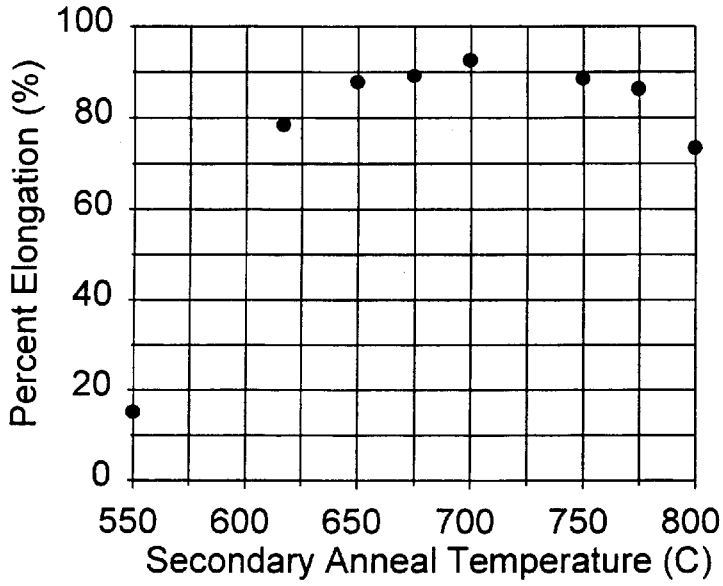
FIG. 2 shows a graph of percent elongation as a function of secondary annealing temperature, in accordance with an embodiment of the present invention.

FIG. 2 is a plot of the percent elongation at fracture as a function of secondary anneal temperature, for a constant secondary anneal time of about 10 minutes. The data shown in FIG. 2 are average values based on at least three samples per secondary annealing temperature. FIG. 2 shows that the ductility of the nitinol samples was drastically increased as the secondary annealing temperature is increased from about 550° C. through 700° C., which corresponds to an apparent peak in ductility.

Figure 3:
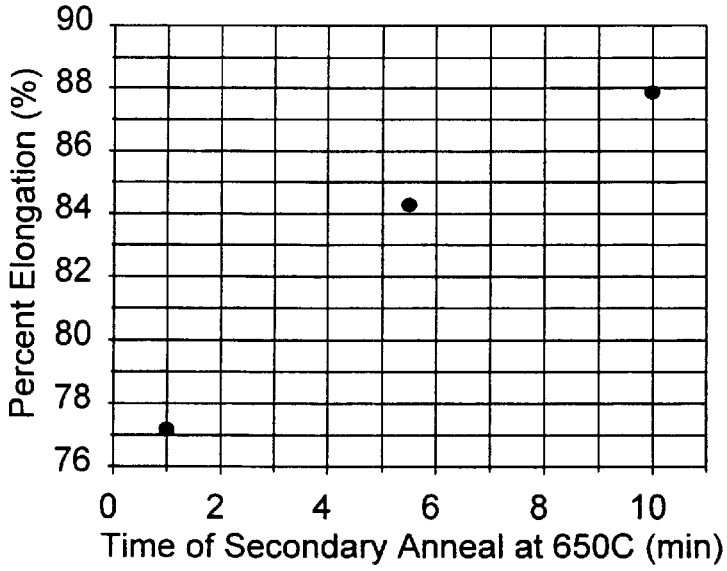
FIG. 3 shows a graph of percent elongation as a function of secondary annealing time, in accordance with an embodiment of the present invention.
Figure 4:
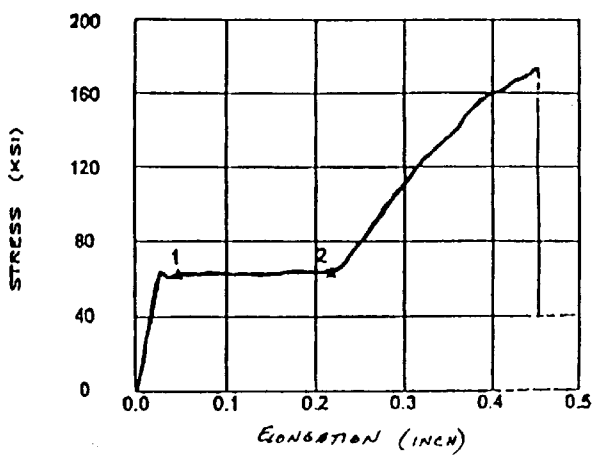
FIGS. 4 to 7 show stress-strain curves for nitinol wires which were treated by an embodiment of the process of the present invention.
Figure 5:
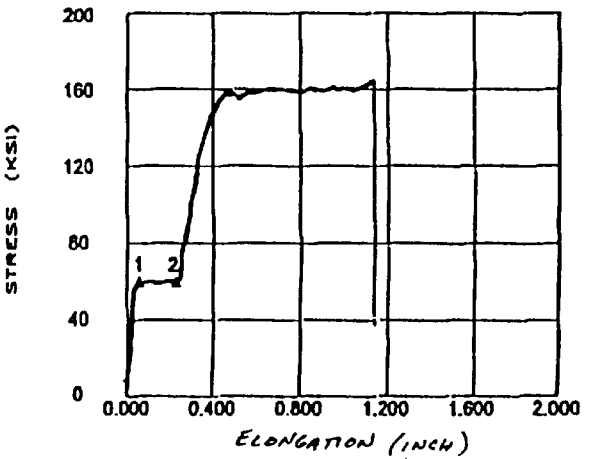
Figure 6:
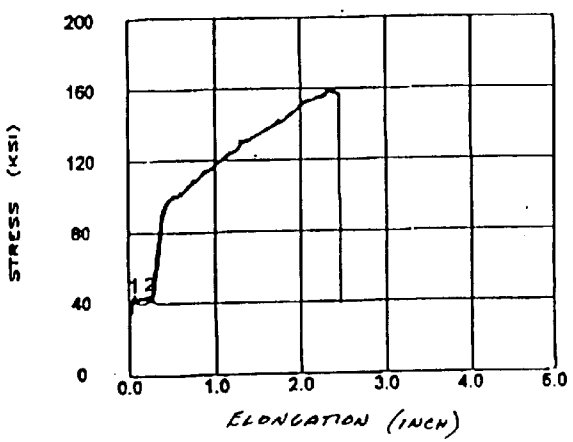
Figure 7:
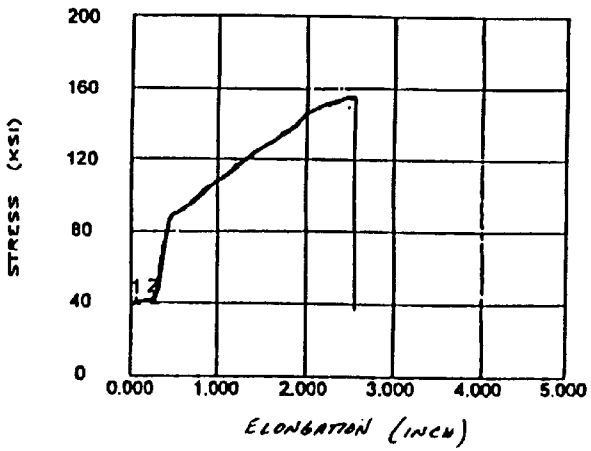

FIG. 3 is a plot of the percent elongation at fracture as a function of secondary annealing time at about 650° C. The data shown in FIG. 3 are average values based on at least two samples per secondary annealing time. FIG. 3 shows that the ductility of the nitinol samples was moderately increased as the secondary annealing time was increased from about 1 to 10 minutes.

FIGS. 4 to 7 show the stress-strain curves for some of the samples tested. Specifically, FIGS. 4 to 7 show the results for wires having secondary annealing temperatures of about 550° C., 600° C., 617° C. and 650° C., respectively, and secondary annealing times of about 10, 1, 10 and 5.5 minutes, respectively.

EXAMPLE 2

A nitinol wire stent was shaped by wrapping a 0.009 inch diameter wire around 0.025 inch pins of a titanium mandrel. The wire had a composition of approximately 55.6 wt % nickel and the balance titanium. While still on the mandrel, the wire was subjected to a primary anneal by submerging in a fluidized bed of sand at about 500° C. After about 10 minutes, the wire was removed from the fluidized bed and immediately water quenched to room temperature. The wire was removed from the mandrel and subjected to a secondary anneal by heating in a convection furnace operating at a temperature of about 650° C. After about ten minutes, the wire was removed from the furnace and immediately water quenched to room temperature. The wire was found to have a percent elongation to fracture of about 105%.

EXAMPLE 3

Figure 8A:
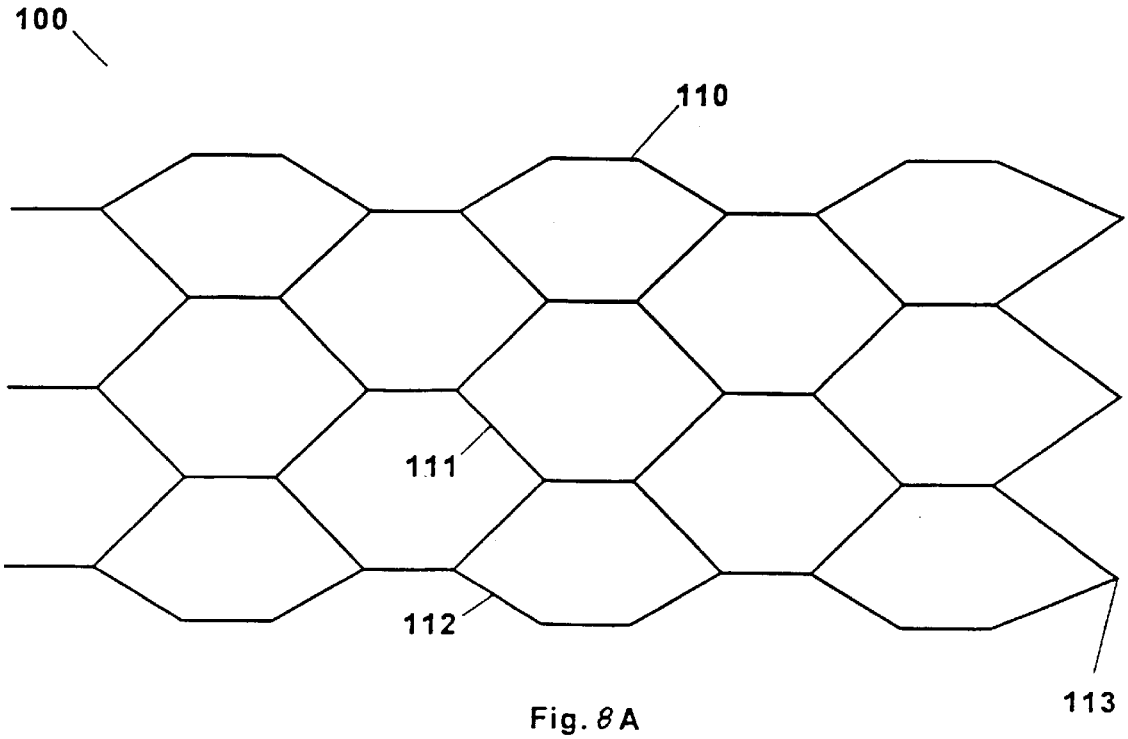
FIGS. 8A and 8B show side and end views of a nitinol stent in accordance with an example of the present invention.

A patterned nitinol wire stent 100 was formed as shown in FIGS. 8A (side view) and 8B (end view). Stent 100 was made from a single nitinol wire 110 wherein adjoining cells (e.g., 111 and 112) are joined by welding. In order for stent 100 to be delivered to a target location within the body (e.g., an artery), it must be compressed and held at a compressed diameter by a removable sheath or the like. One of the limiting factors in the compressibility of the stent 100 is the bend radius to which ends 113 can be subjected without causing fracture. The compressibility of the stent 100, and specifically the cell ends 113, is enhanced by the method of the present invention.

Figure 8B:
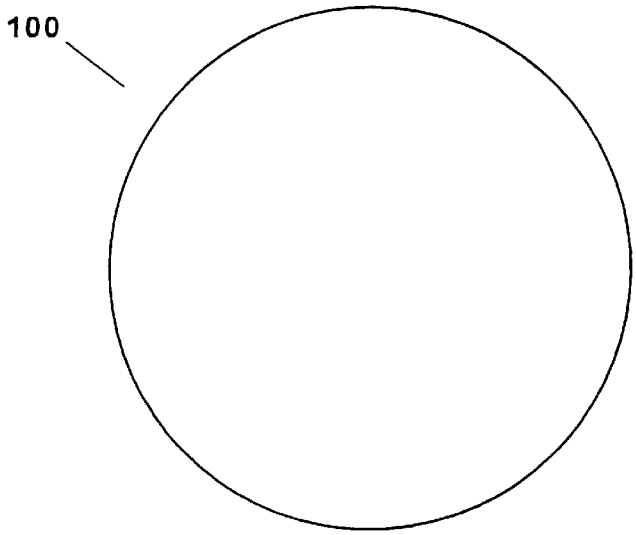

The nitinol wire 110 was shaped into the configuration shown in FIGS. 8A and 8B by wrapping a nitinol wire around 0.025 inch pins of a titanium mandrel. The wire 110 had a composition of approximately 55.9 wt % nickel and the balance titanium. While still on the mandrel, the wire was subjected to a primary anneal by submerging in a fluidized bed of sand at about 500° C. After about 10 minutes, the wire was removed from the fluidized bed and immediately water quenched to room temperature. The wire was removed from the mandrel and the cell ends 113 were subjected to a secondary anneal by isolated heating with an argon torch operating at about 650° C. After about one minute of treating the cell ends 113 with the torch, the wire was immediately water quenched to room temperature. The stent 100 was thereafter compressed such that the cell ends 113 were characterized by a 0.0025 inch bend diameter without causing fracture of the nitinol.

The present invention provides a novel process for treating nitinol so that desired mechanical properties are achieved. Those with skill in the art may recognize various modifications to the embodiments of the invention described and illustrated herein. Such modifications are meant to be covered by the spirit and scope of the appended claims.

What is claimed is:

1. An article comprising nitinol, wherein said nitinol comrises approximately 44 to 60 weight percent nickel with the blance being titanium, wherein at least a portion of said nitinol has been subjected to processing steps including the steps of exposing said nitinol to a temperature of approximately 475° C. to 525° C. for a time period of approximately 10 minutes; and exposing said nitinol to a temperature within the range of approximately 550° C. to 800° C. for a time period within the range of approximately 1 to 10 minutes; and wherein the processing steps result in the nitinol article having an elongation prior to failure in excess of approximately 50% from approximately room temperature to approximately body temperature.

2. The article of claim 1, wherein said nitinol comprises approximately 55 to 56 weight percent nickel.

3. The article of claim 1, wherein the $A_f$ temperature of said nitinol is less than approximately 38° C.

4. The article of claim 1 wherein said article is a stent.

5. The nitinol article of claim 4, wherein the stent is an expandable stent having a generally tubular structure.

6. The article of claim 1, wherein said article is in the form of a wire.

7. The nitinol article of claim 1, wherein said article has an elongation prior to failure in excess of approximately 70%.

8. The nitinol article of claim 1, wherein said article has an elongation prior to failure in excess of approximately 60%.

9. The nitinol article of claim 1, wherein said article has an elongation prior to failure in excess of approximately 80%.

10. The nitinol article of claim 1, wherein said article has an elongation prior to failure in excess of approximately 90%.

11. The nitinol article of claim 1, wherein said article has an elongation prior to failure in excess of approximately 100%.

12. The nitinol article of claim 1, wherein the processing steps are completed in less than approximately 20 minutes.

13. An article comprising nitinol, wherein said nitinol comprises approximately 44 to 60 weight percent nickel with the balance being titanium, wherein at least a portion of said nitinol has been subjected to processing steps including the steps of exposing said nitinol to a first temperature of approximately 475° C. to 525° C. for a first time period; and exposing said nitinol to a second temperature within the range of approximately 550° C. to 800° C. for a second time period;

wherein said first and second time periods are sufficient to ensure that substantially the entire portion of the nitinol reaches the first and second temperature respectively and are held at said temperatures sufficiently long to have an effect on mechanical properties of the nitinol article; and wherein the processing steps result in the nitinol article having an elongation prior to failure in excess of approximately 50% from approximately room temperature to approximately body temperature.

14. An article comprising nitinol, wherein said nitinol comprises approximately 44 to 60 weight percent nickel with the balance being titanium, wherein at least a portion of said nitinol has been subjected to processing steps including the steps of exposing said nitinol to a first temperature of approximately 475° C. to 525° C. for a first time period; and exposing said nitinol to a second temperature within the range of approximately 550° C. to 800° C. for a second time period;

wherein said first and second time periods are sufficient to ensure that substantially the entire portion of the nitinol reaches the first and second temperature respectively and are held at said temperatures sufficiently long to have an effect on mechanical properties of the nitinol article; and wherein the processing steps result in the nitinol article having an elongation prior to failure in excess of approximately 70% at approximately body temperature.

* * * * *